United States Patent [19]

Sakuma et al.

[11] 4,177,039

[45] Dec. 4, 1979

[54] DISPERSANT FOR COAL INTO OILS

[75] Inventors: Kouhei Sakuma, Tokyo; Toshiyuki Ukigai, Yachiyo; Tatsuji Yamashita; Osamu Yamaki, both of Chiba, all of Japan

[73] Assignee: Lion Yushi Kabushiki Kaisha, Tokyo, Japan

[21] Appl. No.: 964,266

[22] Filed: Nov. 27, 1978

[30] Foreign Application Priority Data

Nov. 29, 1977 [JP] Japan ..... 52-143179

[51] Int. Cl.[2] ..... C10L 1/32

[52] U.S. Cl. ..... 44/51; 44/53; 44/68; 44/70; 44/76; 252/308

[58] Field of Search ..... 44/51, 53, 68, 70, 76; 252/308

[56] References Cited

U.S. PATENT DOCUMENTS

| | | | |
|---|---|---|---|
| 1,681,335 | 8/1928 | Griessbach et al. | 44/51 |
| 2,579,890 | 12/1951 | Wies et al. | 44/70 |
| 2,948,596 | 8/1960 | Ambrose et al. | 44/70 |
| 3,116,128 | 12/1963 | Fareri et al. | 44/71 |

*Primary Examiner*—Winston A. Douglas
*Assistant Examiner*—J. V. Howard

[57] ABSTRACT

A dispersant for coal into oils which comprises a metal salt of a dialkyl sulfosuccinate and a lower aliphatic alcohol and a coal-oil mixed fuel containing the dispersant. The coal-oil mixed fuel containing the dispersant is provided with excellent stability and fluidity for a long period of time by virtue of a high dispersing effect of the dispersant.

5 Claims, No Drawings

DISPERSANT FOR COAL INTO OILS

BACKGROUND OF THE INVENTION

This invention relates to a dispersant for coal into oils which is used for dispersing finely pulverized coal into an oil to produce a coal-oil mixed fuel possessing excellent stability and fluidity for an extended period of time and also to a coal-oil mixed fuel containing the dispersant.

In recent years, a quantitative limitation of petroleum reserve has strongly been recognized in addition to a steep rise in the cost of petroleum fuels which occupy the most important position in the energy sources. Thus, a long-term procurement of energy sources becomes very important in the energy policy of nations. Under these circumstances, coal which is larger in the amount of reserve as well as petroleum has again become noticed as a promising energy source. However, a coal is lumpy in shape unlike the case of liquid petroleum, it has such drawbacks that it requires a higher cost in transportation and storage and is inconvenient in handling.

In order to overcome these drawbacks in handling, extensive researches are now made in a method wherein coal is pulverized and dispersed into water or a fuel to form a slurried fuel.

From the past, investigations have been made on a coal-oil mixed fuel wherein pulverized coal has been dispersed into a fuel oil, because this mixed fuel is higher in heat value per unit weight than a mixed fuel having dispersed into water and is recognized more preferably as an energy source. In this case, a problem arises also in handling of the mixed fuel. Thus, a desirable coal-oil mixed fuel has not yet been obtained which is excellent in dispersion-stability and fluidity for a long period of time.

A large quantity of fuels is required for thermal power generation. In general, transportation and storage of such a large quantity of fuels are respectively made by using tankers and large-scale field tanks. In case a large quantity of a coal-oil mixed fuel is transported and stored in such means, a problem arises in that the pulverized coal tends to separate from the oil to permit a precipitation-and-dense-deposition phenomenon of the coal. Once such precipitation-and-dense-deposition of the pulverized coal occurs, the mixed fuel loses fluidity and makes it difficult to be unloaded from tankers or pumped out from storage tanks. Practically, therefore, it is nearly impossible to handle such mixed fuel.

BRIEF SUMMARY OF THE INVENTION

It is an object of the present invention to provide a dispersant for coal into oils which is used for dispersing finely pulverized coal homogeneously into an oil to produce a coal-oil mixed fuel processing excellent stability and fluidity for a long period of time.

It is another object of the present invention to provide a coal-oil mixed fuel which is excellent in stability and fluidity for a long period of time and is easy for storage and pumping.

Other and further objects of the present invention will become obvious upon an understanding of the illustrative embodiments about to be described or will be indicated in the appended claims, and various advantages not referred to herein will occur to one skilled in the art upon employment of the invention in practice.

DETAILED DESCRIPTION OF THE INVENTION

As a result of extensive researches made for overcoming the drawbacks of the conventional coal-mixed fuels and for developing a dispersant capable of affording a coal-oil mixed fuel which is prevented from precipitation and dense deposition of coal in holding tanks in tanker vessels or in field storage tanks and is easily unloaded from holding tanks in the tanker vessels or discharged from the field storage tanks, it has now been found that a coal-oil mixed fuel possessing excellent stability and fluidity for a long period of time can be obtained by dispersing finely pulverized coal into a fuel oil by the aid of a composite surface active agent comprised of a mixture of a metal salt of a dialkylsulfosuccinate and a lower aliphatic alcohol.

This invention has been accomplished on the basis of the above finding.

In the present invention, a dispersant for coal into oils which contains:

(a) a metal salt of a dialkyl sulfosuccinate of the general formula:

$$[R^1O_2C-CH_2-\underset{\underset{SO_3}{|}}{CH}-CO_2R^2]_n \cdot M$$

wherein $R^1$ and $R^2$ each represent an alkyl group with at least 4 carbon atoms, n represents an integer of 1~3 and M represents a metal having a valency of n, and (b) at least one lower aliphatic alcohol selected from the group consisting of a monohydric alcohol having 1~5 carbon atoms, a polyhydric alcohol having 2~5 carbon atoms and an alcohol with 2~5 carbon atoms having an alkoxy group with 1~5 carbon atoms, is used for obtaining a coal-oil mixed fuel excellent in both stability and fluidity and capable of being advantageously transported by a mammoth tanker or stored in a large field tank.

In the constituent (a) of the dispersant, i.e. a metal salt of a dialkyl sulfosuccinate of the above general formula, $R^1$ and $R^2$ are preferably alkyl groups having at least 4, especially 6~12 carbon atoms and M is a metal with a valency of 1~3, preferably Li, K, Na or Ca but may be Al, Mg and Ba.

Illustrative of the constituent (a) are:
dihexyl sodium sulfosuccinate,
di-n-octyl potassium sulfosuccinate,
bis-2-ethylhexyl sodium sulfosuccinate,
bis-2-ethylhexyl potassium sulfosuccinate,
bis-2-ethylhexyl aluminum sulfosuccinate,
di-n-decyl sodium sulfosuccinate,
di-n-dodecyl calcium sulfosuccinate, and
di-lanoline alcohol sodium sulfosuccinate.

The other constituent (b) of the dispersant is a lower aliphatic alcohol having at least one alcoholic hydroxyl group and is selected from a monohydric alcohol having 1~5 carbon atoms, a polyhydric alcohol having 2~5 carbon atoms and an alcohol with 2~5 carbon atoms having an alkoxy group with 1~5 carbon atoms, Illustrative of the lower aliphatic alcohol are methyl alcohol, ethyl alcohol, butyl alcohol, ethylene glycol, propylene glycol, glycerol, ethyl cellosolve, butyl cellosolve and 2-ethyoxypropyl alcohol.

It is important to blend the constituents (a) and (b) in a specific ratio to achieve the object of this invention. The ratio (a)/(b), i.e. the ratio of the metal salt of dialkyl sulfosuccinate to the lower aliphatic alcohol is preferably within the range of 3/2~5/1 by weight. Outside this range, the dispersant tends to decrease in its dispersing effect.

In the production of a coal-oil mixed fuel, the quantity of the dispersant of the present invention added to the mixture depends on the kind of coal, the granular distribution thereof and the kind of oil used. Generally, however, the quantity of the dispersant is within the range of 0.01~10% by weight, preferably 0.1~3 by weight based on the mixed fuel.

The dispersant of the present invention comprised of the two constituents may further be incorporated, if necessary, with a proper amount of water, a solubilizing agent or other surface active agents.

The method of dispersing finely pulverized coal into a fuel oil by the aid of the dispersant of the present invention may be conducted, for example, by dissolving the dispersing constituents (a) and (b) in the oil and then mixing the finely pulverized coal therewith or by admixing a mixture of the dispersing constituents (a) and (b) with a mixture of the finely pulverized coal and the fuel oil. The dispersant of this invention may be admixed at any desired temperature, for example, at 50°~150° C. Admixing of the dispersant may be conducted under atmospheric pressure or under subatmospheric pressure to effect degasification of the mixed fuel.

Various kinds of coal such as anthracite, bituminous coal and brown coal can be used as coal constituent of the mixed fuel. An average particle size of the coal is ordinarily not greater than 100μ while the distribution of the particle size is desirably such that the percentage of the particles passing through a 100 mesh sieve is 100% and preferably the percentage of the particles passing through a 200 mesh sieve is at least 50 percent. Any kind of hydrocarbon oils surch as crude oil, heavy oil, gas oil and gasoline may be used as the fuel oil but the use of crude oil and heavy oil is economically advantageous. The mixing ratio of the coal to the oil in the mixed fuel depends on the required fluidity and stability but the coal/oil ratio is preferably determined within the range from 6/4 to 3/7 by weight. When the amount of coal exceeds 60% by weight of the mixture, the resultant mixed fuel will tend to show poor fluidity. On the other hand, when the amount of coal is less than 30%, the mixed fuel will tend to show poor stability.

The coal, depending on the method of drying, normally contains some amount of attached water. The dispersant of the present invention is not influenced by this kind of attached water. However, when the amount of attached water (including water externally added) is excessively large, the combustion efficiency of the mixed fuel will be decreased to incur a trouble on the use of the fuel. Therefore, the amount of water is desirably not greater than 20%, preferably not greater than 10% by weight of the mixed fuel. One of the greatest characters of the dispersant of this invention is that the dispersant exhibits an excellent dispersing effect regardless of whether the mixed fuel is substantially anhydrous or contains about 1~5% by weight of water.

In general, the coal-oil mixed fuel prepared by the aid of the dispersant of this invention has the following composition:

| | |
|---|---|
| Coal (finely pulverized coal) | 30~60% by weight |
| Fuel oil | 40~70% by weight |
| Dispersant | 0.01~10% by weight (preferably 0.1~3% by weight) |
| Water | 0~20% by weight (preferably 0–10% by weight) |

In the production of the coal-oil mixed fuel comprising the finely pulverized coal, the fuel oil and the dispersant of the present invention, there are no limitation in the method of admixing the above mentioned constituents, the order of adding them, the kind of stirrers for admixing and the stirring condition, so far as the effect of the dispersant is not particularly disturbed.

The present invention will be illustrated in more detail by way of examples wherein "part" and percentage are on weight basis. The rod penetration referred to in the following example was performed in the following manner:

A stainless steel cylinder of 5.5 cm in inner diameter and 24 cm in height was used as testing instrument, which was provided with sample outlets each with a stop valve in the positions at heights of 6 cm, 12 cm and 18 cm from the bottom.

A mixed fuel to be tested was introduced into the cylinder up to the height of 18 cm from the bottom thereof and the upper open end of the cylinder was covered with a lid having a guide hole at the center thereof.

A glass rod with a flat end having the diameter of 5 mm and the total weight of 20 g was allowed to fall vertically through the guide hole and the time required for travelling the rod end from the surface of the mixed fuel to the bottom of the cylinder was measured. This time is defined and recorded as penetration time. A shorter penetration time means that the mixed fuel has a low degree of precipitation and dense deposition.

After the rod penetration test, the sample was devided into three sections:

- the upper section—the sample of the upper part above the height of 12 cm from the bottom of the cylinder,
- the middle section—the sample of the middle part between the heights of 12 cm and 6 cm from the bottom of the cylinder, and
- the lower section—the sample of the lower part below the height of 6 cm from the bottom of the cylinder.

The viscosity of the mixed fuel and the concentration of the coal in each section was measured. The above mentioned rod penetration test and the measurement of viscosity were both made at 70° C.

The properties of the coal and the oil used in this experiment are shown in Table 1 and Table 2, respectively.

Table 1

| Properties of heavy oil Items | Value measured |
|---|---|
| Specific gravity (70° C.) | 0.908 |
| Viscosity (70° C.) | 39.2 cp |
| Pour point | 0° C. |
| Water | 0.2% |

Table 1-continued

| Properties of heavy oil Items | Value measured |
|---|---|
| Flush point | 106° C. |

Table 2

| Properties of coal Items | Value measured |
|---|---|
| Specific gravity (70° C.) | 1.420 |
| Ash content | 11.3% |
| Moisture | 3.8% |
| Volatile matter | 31% |
| Fixed carbon content | 52% |
| Particle size distribution | |
| +150 mesh | 2.6% |
| 150~200 mesh | 13.1% |
| 200~350 mesh | 33.2% |
| −350 mesh | 51.1% |

EXAMPLE 1

A mixture (total weight: 500 g) of 49.7% of the heavy oil, 50% of the coal and 0.3% of a dispersant (bis-2-ethylhexyl sodium sulfosuccinate/propylene glycol=4/1) was placed in a container, kneaded by hand at 70° C. and then stirred at the speed of 5000 r.p.m. at 70° C. for 20 minutes with the aid of a homogenizer to prepare a mixed fuel.

The properties of the mixed fuel were measured before and after the settling test for 30 days. The results of the test are shown in Table 3.

From the results shown in Table 3, it is evident that the dispersant of the present invention serves to minimize the degree of precipitation of the coal so as to keep the difference in viscosity between the upper section and the lower section permissible and that the mixed fuel using the dispersant of this invention possesses excellent stability and fluidity.

Table 3

| Items | | Before settling | After settling |
|---|---|---|---|
| Viscosity at 70° C. (cp) | Upper section | | 540 |
| | Middle section | 850 | 980 |
| | Lower section | | 1300 |
| Rod penetration test (sec.) | | 0.7 | 1.0 |
| Concentration of coal (%) | Upper section | | 47.6 |
| | Middle section | 500 | 51.2 |
| | Lower section | | 52.4 |

EXAMPLE 2

A coal-oil mixed fuel was prepared in the same manner as described in Example 1 except that the constituents (a) and (b) of the dispersant, the weight ratio (b)/(a) and the quantity of each constituent were varied.

The viscosity of this sample was measured before the settling test and the rod penetration time was also measured before and after the settling test conducted for 30 days at 70° C.

The results obtained are shown in Table 4.

The quantity of heavy fuel oil used in this experiment was varied according to the quantity of the dispersant.

Table 4

| No. | Constituent (a) | Dispersant Constituent (b) | Ratio (%) (a) | (b) | Water | Amount added (%) | Viscosity at 70° C. before settling | Rod penetration time (sec) before settling | after settling |
|---|---|---|---|---|---|---|---|---|---|
| | | | | | | | cp | | |
| 1 | Bis-2-ethylhexyl sodium sulfosuccinate | Ethyl alcohol | 80 | 20 | — | 0.3 | 870 | 0.8 | 1.5 |
| 2 | Di-n-octyl sodium sulfosuccinate | Ethylene glycol monobutyl ether | 70 | 30 | — | 0.3 | 880 | 0.8 | 1.8 |
| 3 | Bis-2-ethylhexyl potassium sulfosuccinate | Ethylene glycol | 60 | 40 | — | 0.3 | 830 | 0.8 | 1.1 |
| 4 | Di-dodecyl sodium sulfosuccinate | Propylene glycol | 80 | 20 | — | 0.3 | 910 | 0.8 | 5.9 |
| 5 | Bis-2-ethylhexyl sodium sulfosuccinate | Propylene glycol | 70 | 15 | 15 | 0.2 | 850 | 0.8 | 1.0 |
| 6 | Bis-2-ethylhexyl sodium sulfosuccinate | Propylene glycol | 70 | 15 | 15 | 0.1 | 800 | 0.7 | 6.7 |
| 7 | Bis-2-ethylhexyl sodium sulfosuccinate | Ethyl alcohol | 50 | 10 | 40 | 0.3 | 860 | 0.8 | 1.3 |
| 8* | Bis-2-ethylhexyl sodium sulfosuccinate | — | 100 | — | — | 0.2 | 870 | 0.8 | 53.8 |
| 9* | — | Propylene glycol | — | 100 | — | 0.2 | 750 | 0.8 | not penetrated |

Remarks:
Nos. 8 and 9 marked with an asterisk (*) stand for comparative examples.

As many apparently widely different embodiments of this invention may be made without departing from the spirit and scope thereof, it is construed that this invention is not limited to the specific embodiments illustrated in examples except as defined in the appended claims.

What is claimed is:

1. A dispersant for coal into oils which comprises:

(a) a metal salt of a dialkyl sulfosuccinate of the general formula:

$$[R^1O_2C-CH_2-\underset{\underset{SO_3}{|}}{CH}-CO_2R^2]_n \cdot M$$

wherein $R^1$ and $R^2$ each represent an alkyl group having at least 4 carbon atoms, n represents an integer of 1~3 and M represents a metal having a valency of n, and (b) at least one lower aliphatic alcohol selected from the group consisting of a monohydric alcohol having 1~5 carbon atoms, a polyhydric alcohol having 2~5 carbon atoms and an alcohol with 2~5 carbon atoms having an alkoxy group with 1~5 carbon atoms.

2. A dispersant according to claim 1 wherein the weight ratio of the metal salt of the dialkyl sulfosuccinate (a) to the lower aliphatic alcohol (b), represented by (a)/(b) is within the range from 3/2 to 5/1.

3. A coal-oil mixed fuel containing 0.01~10% by weight of a dispersant comprising:

(a) a metal salt of a dialkyl sulfosuccinate of the general formula:

$$[R^1O_2C-CH_2-\underset{\underset{SO_3}{|}}{CH}-CO_2R^2]_n \cdot M$$

wherein $R^1$ and $R^2$ each represent an alkyl group having at least 4 carbon atoms, n represents an integer of 1~3 and M represents a metal having a valency of n, and (b) at least one lower aliphatic alcohol selected from the group consisting of a monohydric alcohol having 1~5 carbon atoms, a polyhydric alcohol having 2~5 carbon atoms, and an alcohol with 2~5 carbon atoms having an alkoxy group with 1~5 carbon atoms.

4. A mixed fuel according to claim 3 wherein the weight ratio of the metal salt of dialkyl sulfosuccinate (a) to the lower aliphatic alcohol (b), represented by (a)/(b), is within the range from 3/2 to 5/1.

5. A mixed fuel according to claim 3 wherein the coal/oil ratio is within the range of 1.5~0.9 by weight.

* * * * *